US011286932B2

(12) United States Patent
Swartzlander

(10) Patent No.: US 11,286,932 B2
(45) **Date of Patent: *Mar. 29, 2022**

(54) OPTIMIZED HELIX ANGLE ROTORS FOR ROOTS-STYLE SUPERCHARGER

(71) Applicant: Eaton Intelligent Power Limited, Dublin (IE)

(72) Inventor: Matthew G. Swartzlander, Battle Creek, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/556,510

(22) Filed: Aug. 30, 2019

(65) Prior Publication Data

US 2019/0383287 A1 Dec. 19, 2019

Related U.S. Application Data

(63) Continuation of application No. 15/354,234, filed on Nov. 17, 2016, now Pat. No. 10,436,197, which is a (Continued)

(51) Int. Cl.
*F04C 18/18* (2006.01)
*F04C 18/08* (2006.01)
(Continued)

(52) U.S. Cl.
CPC ..... *F04C 18/18* (2013.01); *F04C 18/084* (2013.01); *F04C 18/126* (2013.01); *F04C 18/16* (2013.01);
(Continued)

(58) Field of Classification Search
CPC ..... F04C 18/084; F04C 18/16; F04C 18/18
See application file for complete search history.

(56) References Cited

U.S. PATENT DOCUMENTS 1,746,885 A 2/1930 Bunge et al.
2,014,932 A 9/1935 Hallett
(Continued)

FOREIGN PATENT DOCUMENTS

GB 676839 A 8/1952

OTHER PUBLICATIONS

International Search Report PCT/US2017/061945, dated Apr. 23, 2018.

*Primary Examiner* — Mary Davis
(74) *Attorney, Agent, or Firm* — Fishman Stewart PLLC

(57) ABSTRACT

A blower may include a blower housing that may include a plurality of rotor chambers and a plurality of rotors. The plurality of rotors may be substantially identical and each may include a twist angle and a helix angle. The rotors and the blower housing may be configured to create internal fluid compression when the rotors are rotating at a first rotational speed and not to create internal fluid compression when the rotors are rotating at a second rotational speed. The rotors and the blower housing may be configured to create the internal fluid compression without backflow slots in the blower housing. The twist angle may include the angular displacement of lobes of the plurality of rotors between axial ends of the plurality of rotors. The helix angle may be a function of the twist angle and a pitch diameter of the plurality of rotors.

21 Claims, 11 Drawing Sheets

Related U.S. Application Data continuation-in-part of application No. 14/158,163, filed on Jan. 17, 2014, now abandoned, which is a continuation of application No. 12/915,996, filed on Oct. 29, 2010, now Pat. No. 8,632,324, which is a continuation of application No. 12/331,911, filed on Dec. 10, 2008, now Pat. No. 7,866,966, which is a continuation of application No. 11/135,220, filed on May 23, 2005, now Pat. No. 7,488,164.

(51) Int. Cl.

| | |
|---|---|
| ***F04C 18/16*** | (2006.01) |
| ***F04C 18/12*** | (2006.01) |
| ***F02B 33/38*** | (2006.01) |
| ***F04C 29/12*** | (2006.01) |

(52) U.S. Cl.

CPC ..... *F02B 33/38* (2013.01); *F04C 29/12* (2013.01); *F04C 2240/30* (2013.01); *F04C 2250/20* (2013.01)

(56) References Cited

U.S. PATENT DOCUMENTS

| | | | | | |
|---|---|---|---|---|---|
| 2,028,414 | A | | 1/1936 | Schneider | |
| 2,048,249 | A | | 7/1936 | Elwert | |
| 2,078,334 | A | * | 4/1937 | Martocello | F04C 18/16 418/203 |
| 2,259,027 | A | | 10/1941 | De Zarate et al. | |
| 2,448,901 | A | | 9/1948 | McCulloch et al. | |
| 2,454,048 | A | | 11/1948 | Flanagan | |
| 2,463,080 | A | | 3/1949 | Beier | |
| 2,480,818 | A | | 8/1949 | Whitfield | |
| 2,530,173 | A | * | 11/1950 | Oldberg | F04C 18/16 418/201.3 |
| 2,547,169 | A | | 4/1951 | Paget | |
| 2,654,530 | A | | 10/1953 | Oldberg | |
| 2,691,482 | A | | 10/1954 | Ungar | |
| 2,906,448 | A | | 9/1959 | Lorenz | |
| 3,058,652 | A | | 10/1962 | Glamann | |
| 3,121,529 | A | | 2/1964 | Hubrich | |
| 3,151,806 | A | | 10/1964 | Whitfield | |
| 3,531,227 | A | | 9/1970 | Weatherston | |
| 3,667,874 | A | | 6/1972 | Weatherston et al. | |
| 3,787,154 | A | | 1/1974 | Edstrom | |
| 3,844,695 | A | | 10/1974 | Weatherston | |
| 3,986,801 | A | | 10/1976 | Garland | |
| 4,042,062 | A | | 8/1977 | Tooley | |
| 4,135,602 | A | | 1/1979 | Clark | |
| 4,210,410 | A | | 7/1980 | Ohtani | |
| 4,215,977 | A | | 8/1980 | Weatherston | |
| 4,329,130 | A | | 5/1982 | Nagata et al. | |
| 4,556,373 | A | | 12/1985 | Soeters, Jr. | |
| 4,560,333 | A | | 12/1985 | Fujiwara et al. | |
| 4,564,345 | A | | 1/1986 | Mueller | |
| 4,609,329 | A | | 9/1986 | Pillis et al. | |
| 4,609,335 | A | | 9/1986 | Uthoff, Jr. | |
| 4,643,655 | A | | 2/1987 | Uthoff, Jr. | |
| 4,768,934 | A | | 9/1988 | Soeters, Jr. | |
| 5,078,583 | A | | 1/1992 | Hampton et al. | |
| 5,083,907 | A | | 1/1992 | Brownell | |
| 5,979,168 | A | | 11/1999 | Beekman | |
| 6,758,661 | B1 | | 7/2004 | Thelen | |
| 6,884,050 | B2 | | 4/2005 | Prior | |
| 7,488,164 | B2 | | 2/2009 | Swartzlander | |
| 7,726,285 | B1 | | 6/2010 | Hansen et al. | |
| 7,866,966 | B2 | | 1/2011 | Swartzlander | |
| 8,632,324 | B2 | | 1/2014 | Swartzlander | |
| 9,587,521 | B2 | * | 3/2017 | Eybergen | F01N 3/0205 |
| 10,436,197 | B2 | * | 10/2019 | Swartzlander | F04C 18/084 |
| 2004/0194766 | A1 | | 10/2004 | Prior et al. | |
| 2006/0263230 | A1 | | 11/2006 | Swartzlander | |
| 2015/0132171 | A1 | | 5/2015 | Knutsson et al. | |

* cited by examiner

OPTIMIZED HELIX ANGLE ROTORS FOR ROOTS-STYLE SUPERCHARGER

RELATED APPLICATIONS

This application is a continuation of U.S. application Ser. No. 15/354,234, filed Nov. 17, 2016, which is a continuation-in-part of U.S. patent application Ser. No. 14/158,163, filed on Jan. 17, 2014, which is a continuation of U.S. patent application Ser. No. 12/915,996, filed on Oct. 29, 2010, now U.S. Pat. No. 8,632,324, issued Jan. 21, 2014, which is a continuation of U.S. patent application Ser. No. 12/331,911 filed on Dec. 10, 2008, now U.S. Pat. No. 7,866,966, issued Jan. 11, 2011, which is a continuation of U.S. patent application Ser. No. 11/135,220, filed on May 23, 2005, now U.S. Pat. No. 7,488,164, issued Feb. 10, 2009. The entire disclosures of all the above applications are hereby incorporated by reference herein as though fully set forth in their entireties.

BACKGROUND

The present teachings relate to Roots-type blowers, and more particularly, to such blowers in which the lobes are not straight (e.g., parallel to the axis of the rotor shafts), but instead are "twisted" to define a helix angle.

Roots-type blowers may be used for moving volumes of air in applications such as boosting or supercharging vehicle engines. A Roots-type blower supercharger may be configured to transfer, into the engine combustion chambers, volumes of air which are greater than the displacement of the engine, thereby raising ("boosting") the air pressure within the combustion chambers to achieve greater engine output horsepower. The present disclosure is not limited to a Roots-type blower for use in engine supercharging, but will be described in connection therewith for illustrative purposes.

In some configurations, a Roots-type blower may include two rotors each having two straight lobes. In other configurations, Roots-type blowers may include three lobes and the lobes may be twisted. In some configurations, a Roots-type blower may include two identical rotors, wherein the rotors may be arranged so that, as viewed from one axial end, the lobes of one rotor are twisted clockwise, while the lobes of the meshing rotor are twisted counter-clockwise. Twisted lobes on the rotors of a blower may result in a blower having significantly better air handling characteristics, which may include producing significantly less air pulsation and turbulence.

An example of a Roots-type blower is shown in U.S. Pat. No. 2,654,530, assigned to the assignee of the present application and incorporated herein by reference in its entirety. Some Roots-type blowers, which may be used as vehicle engine superchargers, may be of a "rear inlet" and/or "axial inlet" type, e.g., a supercharger may be mechanically driven by means of a pulley that may be disposed toward the front end of the engine compartment while the air inlet to the blower is disposed at the opposite end, e.g., toward the rearward end of the engine compartment. In some Roots-type blowers, the air outlet may be formed in a housing wall, such that the direction of air flow as it flows through the outlet may be radial relative to the axis of the rotors. Such blowers may be referred to as being of the "axial inlet, radial outlet" type. It should be understood that the present disclosure is not limited to use in the axial inlet, radial outlet type, but will be described in connection therewith for example only.

Another example of a Roots-type blower is shown in U.S. Pat. No. 5,078,583, also assigned to the assignee of the present invention and incorporated herein by reference in its entirety. Roots-type blowers of the "twisted lobe" type may include an outlet port that is generally triangular, and the apex of the triangle may be disposed in a plane containing an outlet cusp defined by the overlapping rotor chambers. Angled sides of the triangular outlet port may define an angle which is substantially equal to the helix angle of the rotors (e.g., the helix angle at the lobe O.D.), such that each lobe, in its turn, may pass by the angled side of the outlet port in a "line-to-line" manner. In accordance with the teachings of the above-incorporated U.S. Pat. No. 5,078,583, some Roots-type blowers include a backflow slot on either side of the outlet port to provide for backflow of outlet air to transfer control volumes of air trapped by adjacent unmeshed lobes of the rotor, just prior to traversal of the angled sides of the outlet port. The present disclosure is not limited to use with a blower housing having a triangular outlet port in which the angle defined by the angled side corresponds to the helix angle of the rotors, but will be described in connection therewith for example only.

Roots-type blowers may include overlapping rotor chambers, with the locations of overlap defining what are typically referred to as a pair of "cusps." An "inlet cusp" may refer to the cusp adjacent the inlet port and the term "outlet cusp" may refer to the cusp which is interrupted by the outlet port. It should be understood that references to a "helix angle" of the rotor lobes may include the helix angle at the pitch circle of the lobes and/or may be a function of the twist angle and a pitch diameter of the plurality of rotors.

In examples of the present teachings, a Roots-type blower may include a "seal time" wherein the reference to "time" may actually be an angular measurement (e.g., in rotational degrees). Therefore, "seal time" may refer to the number of degrees that a rotor lobe (or a control volume) travels in moving through a particular "phase" of operation, as the various phases will be described hereinafter. In examples of the present teachings, a lobe separation may include the number of degrees between adjacent lobes. In some configurations, for a Roots-type blower having three lobes, the lobe separation (L.S.) may be represented by the equation: L.S.=360/N and with N=3, the lobe separation L.S. may be 120 degrees. A Roots-type blower may include four phases of operation, and for each phase there may be an associated seal time as follows: (1) an "inlet seal time," which may include the number of degrees of rotation during which the control volume is exposed to the inlet port; (2) a "transfer seal time," which may include the number of degrees of rotation during which the transfer volume is sealed from both the inlet "event" and the backflow "event"; (3) a "backflow seal time," which may include the number of degrees during which the transfer volume is open to a backflow port, prior to discharging to the outlet port; and (4) an "outlet seal time," which may include the number of degrees during which the transfer volume is exposed to the outlet port.

Another parameter of a Roots-type blower may include a twist angle of each lobe (e.g., angular displacement, in degrees), which may occur in "traveling" from the rearward end of the rotor to the forward end of the rotor. In some configurations, a Roots-type blower may include a particular twist angle and that angle may be utilized in designing and developing subsequent blower models. By way of example only, a sixty degree twist angle on the lobes of blower rotors may be employed, and it may correspond to the largest twist angle that a lobe hobbing cutter can accommodate. In examples of the present teachings, the twist angle may be predetermined and the helix angle for the lobe may then be determined, such as described in further detail subsequently. In some configurations, a Roots-type blower may include a greater twist angle (for example, as much as 120 degrees), which may result in a higher/greater helix angle and an improved performance, specifically, a higher thermal compressor efficiency, and lower input power.

In some configurations, air flow characteristics of a Roots-type blower and the speed at which the blower rotors can be rotated may be a function of the lobe geometry, including the helix angle of the lobes. It may be desirable for the linear velocity of the lobe mesh (e.g., the linear velocity of a point at which meshed rotor lobes move out of mesh) to approach the linear velocity of the air entering the rotor chambers through the inlet port. If the linear velocity of the lobe mesh (which may be referred to hereinafter as "V3") is much greater than the linear velocity of incoming air (which may be referred to hereinafter as "V1"), the movement of the lobe may, in effect, draw at least a partial vacuum on the inlet side. Such a mismatch of V1 and V3 may cause pulsations, turbulence, and/or noise, and creating such requires "work." Pulsations, turbulence, and/or noise may be may undesirable, such as for an engine supercharger that may rotate at speeds of as much as 15,000 to about 18,000 rpm or more.

It would be desirable to increase the "pressure ratio" of a blower (e.g., the ratio of the outlet pressure (absolute) to inlet pressure (absolute)). A higher pressure ratio may result in a greater horsepower boost for the engine with which the blower is associated. In some configurations, it may be desirable to prevent a Roots-type blower from exceeding a pressure ratio that results in an outlet air temperature in excess of 150 degrees Celsius.

SUMMARY

A Roots-type blower may include a housing defining first and second transversely overlapping cylindrical chambers and first and second meshed, lobed rotors disposed, respectively, in said first and second chambers. The housing may include a first end wall defining an inlet port, and an outlet port formed at an intersection of the first and second chambers and adjacent to a second end wall. Each rotor may include a number of lobes, each lobe having first and second axially facing end surfaces sealingly cooperating with said first and second end walls, respectively, and a top land sealingly cooperating with said cylindrical chambers, said lobes defining a control volume between adjacent lobes on a rotor. In examples of the present teachings, the inlet port may be in at least partial communication with two control volumes on each of the first and second rotors.

In examples of the present teachings, the lobes may cooperate with an adjacent surface of the first and second chambers to define at least one internal backflow passage that occurs in a cyclic manner and moves linearly, as the lobe mesh moves linearly, in a direction toward the outlet port. The internal backflow passage may provide adjacent control volumes in communication. At a first rotor rotational speed, the internal backflow passage may provide fluid communication between adjacent control volumes such that there is no internal compression of the fluid within the blower and, at a second rotor rotational speed greater than the first rotor rotational speed, the internal backflow passage may provide fluid communication between adjacent control volumes such that there is internal compression of the fluid within the blower.

DETAILED DESCRIPTION

Figure 1:
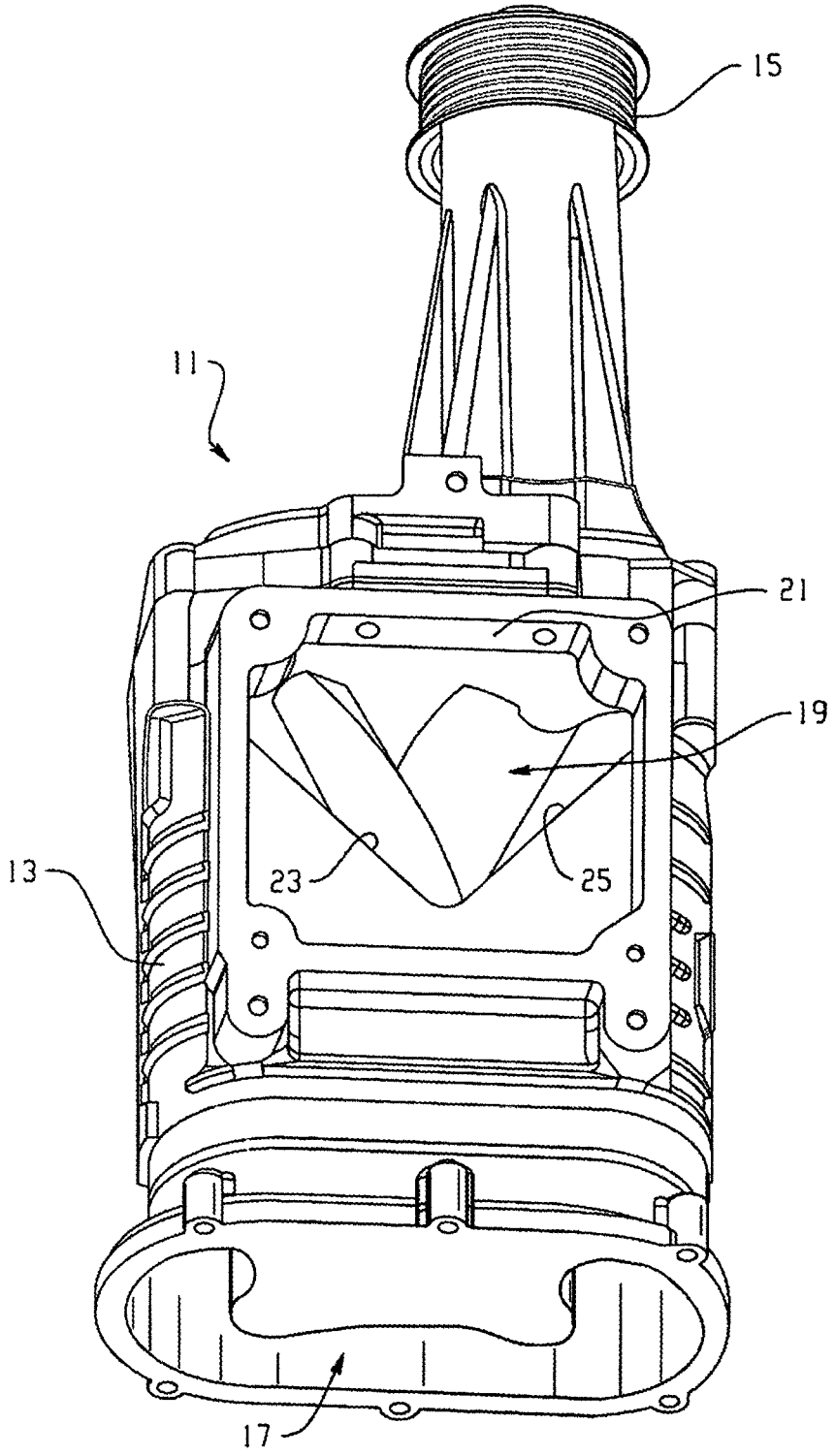
FIG. 1 is a perspective view of a Roots-type blower according to aspects of the present teachings, showing both the inlet port and the outlet port.

Referring now to the drawings, which are not intended to limit the examples of the present teachings, FIG. 1 is an external, perspective view of a Roots-type blower, generally designated 11, which includes a blower housing 13. Blower 11 may be of a rear/axial inlet, radial outlet type (e.g., inlet port 17 may be an axial inlet port and/or outlet 19 may be a radial outlet port) and/or mechanical input to drive the blower rotors may be via a pulley 15. Pulley 15 may be disposed toward a forward end of the engine compartment. Toward the "lower" end of the view in FIG. 1, the blower housing 13 may define an inlet port, generally designated 17.

Figure 2:
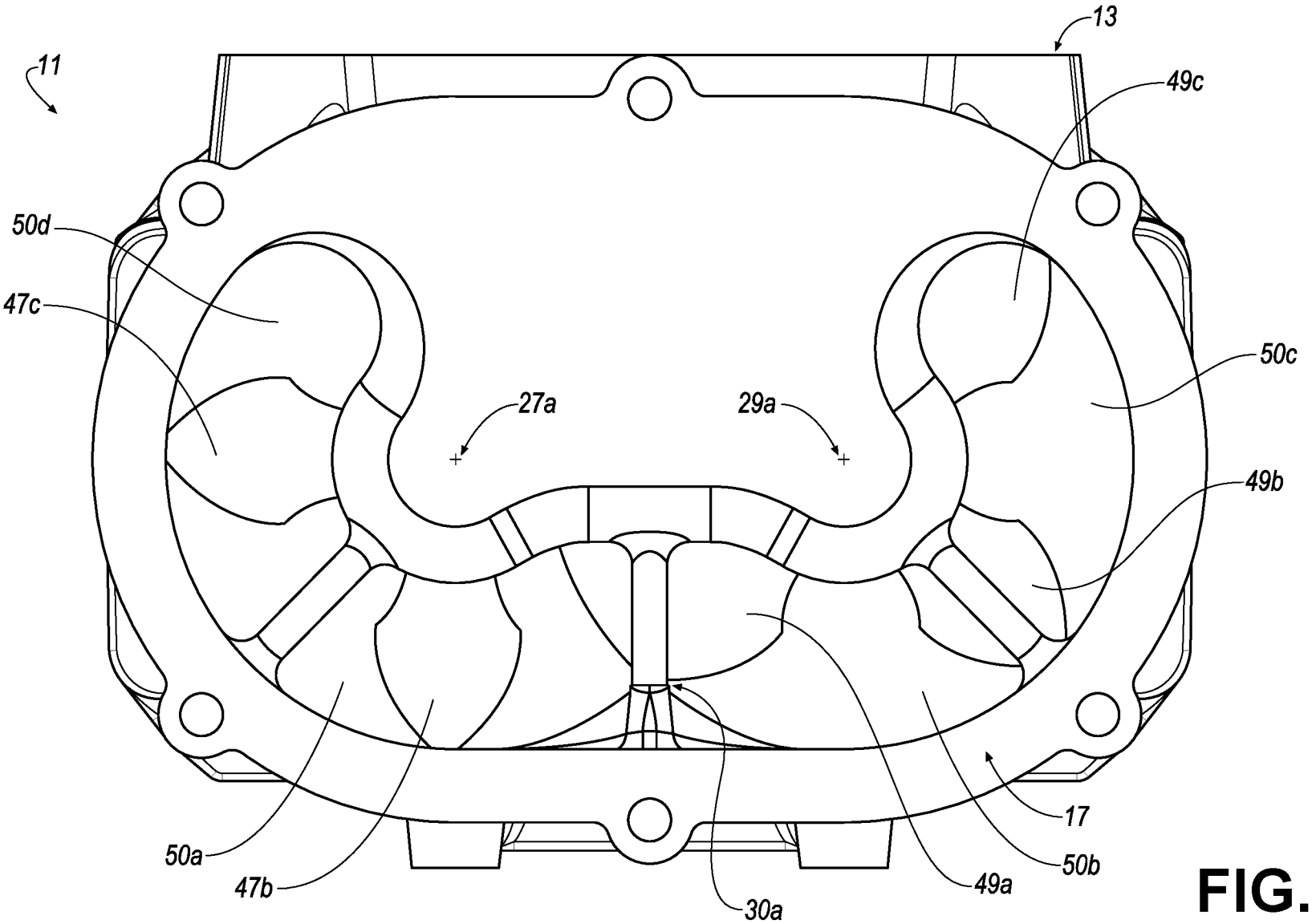
FIG. 2 is a side view of a Roots-type blower according to aspects of the present teachings.
Figure 3:
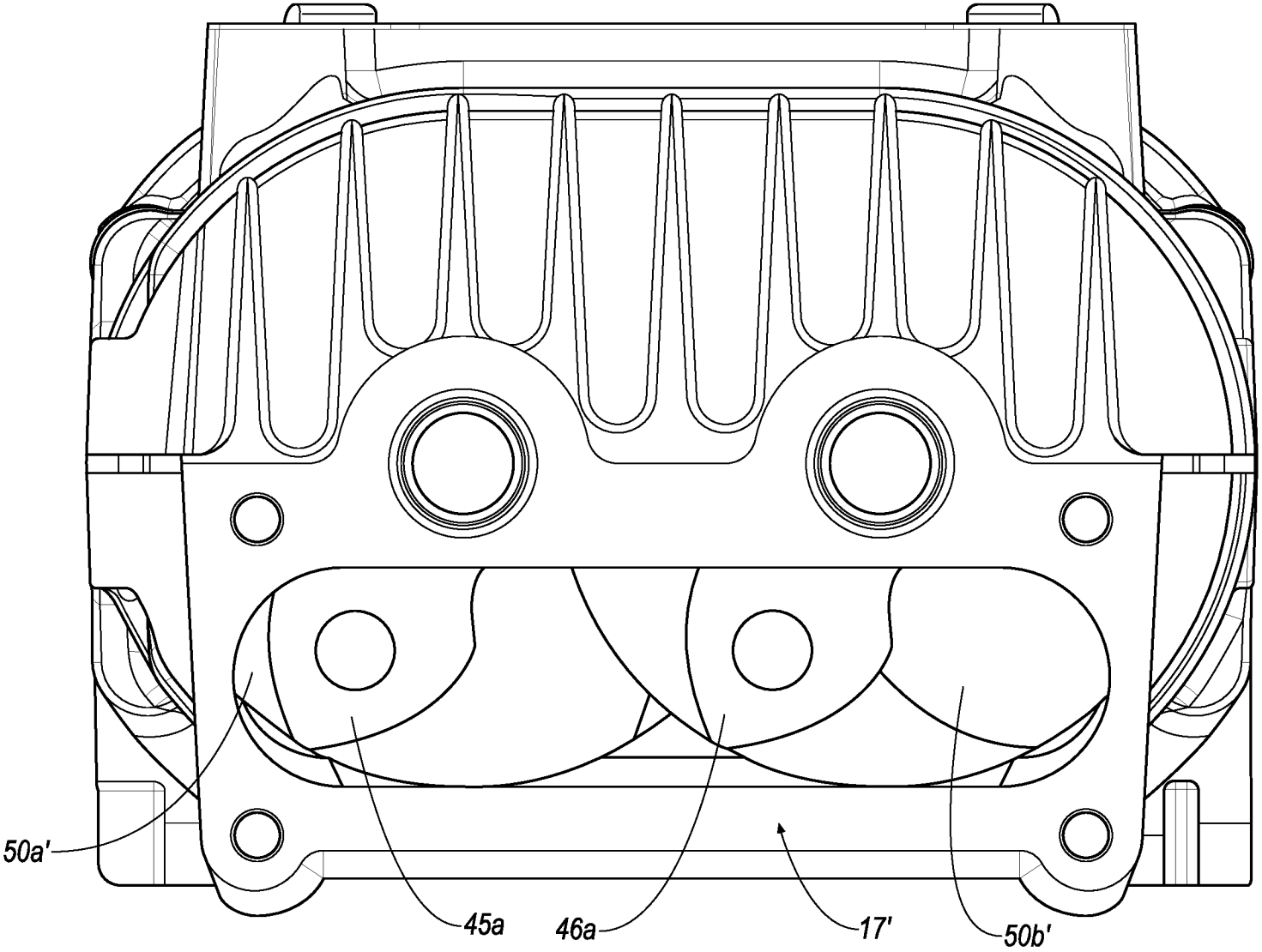
FIG. 3 is a side view of a Roots-type blower.

Blower housing 13 may define an outlet port, generally designated 19 which, as may best be seen in FIG. 1, may be generally triangular. Outlet port 19 may include an end surface 21, which may be generally perpendicular to an axis A (see, e.g., FIG. 4) of blower 11, and/or may include a pair of side surfaces 23 and 25. It will be appreciated that in light of the present disclosure that it may be desirable for inlet port 17 to be configured such that the inlet seal time may be at least equal to the amount of the rotor lobe twist angle. As generally illustrated in FIGS. 1 and 2, a greater twist angle may correspond to a greater extent of inlet port 17 (e.g., in rotational degrees), relative to a conventional inlet port 17', such as generally illustrated in FIG. 3. The outside of the inlet port may be constrained by (e.g., may not be greater than) the outside diameter of the rotor bores. The inlet seal time may be at least equal to the twist angle, which may insure that the transfer volume is fully out of mesh prior to closing off communication of this volume to the inlet port. As generally illustrated in FIG. 3, conventional blowers may include a generally rectangular inlet portion 17'. As generally illustrated in FIG. 2, inlet port 17 of blower 11 may include a greater extent, which may include one or more generally curved portions that may extend beyond chamber axis 27*a* and/or chamber axis 29*a*. Inlet port 17 may be in fluid communication with a plurality of control volumes. For example, inlet port 17 may be in simultaneous fluid communication with at least four control volumes (e.g., if rotors of the blower 11 include four lobes).

Figure 4:
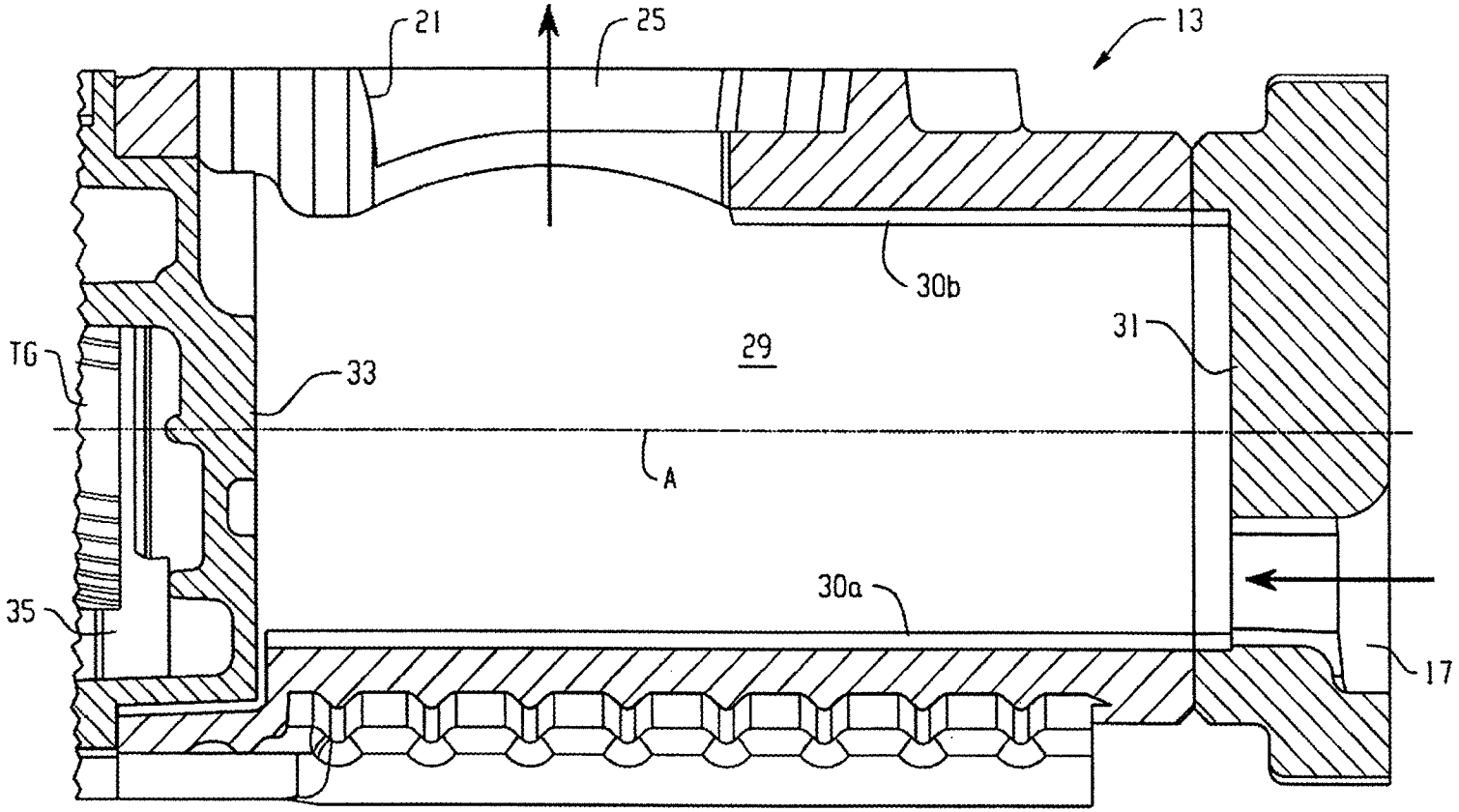
FIG. 4 is an axial cross-section of a housing of the Roots-type blower shown in perspective view in FIG. 1, but with the rotors removed for ease of illustration.
Figure 5:
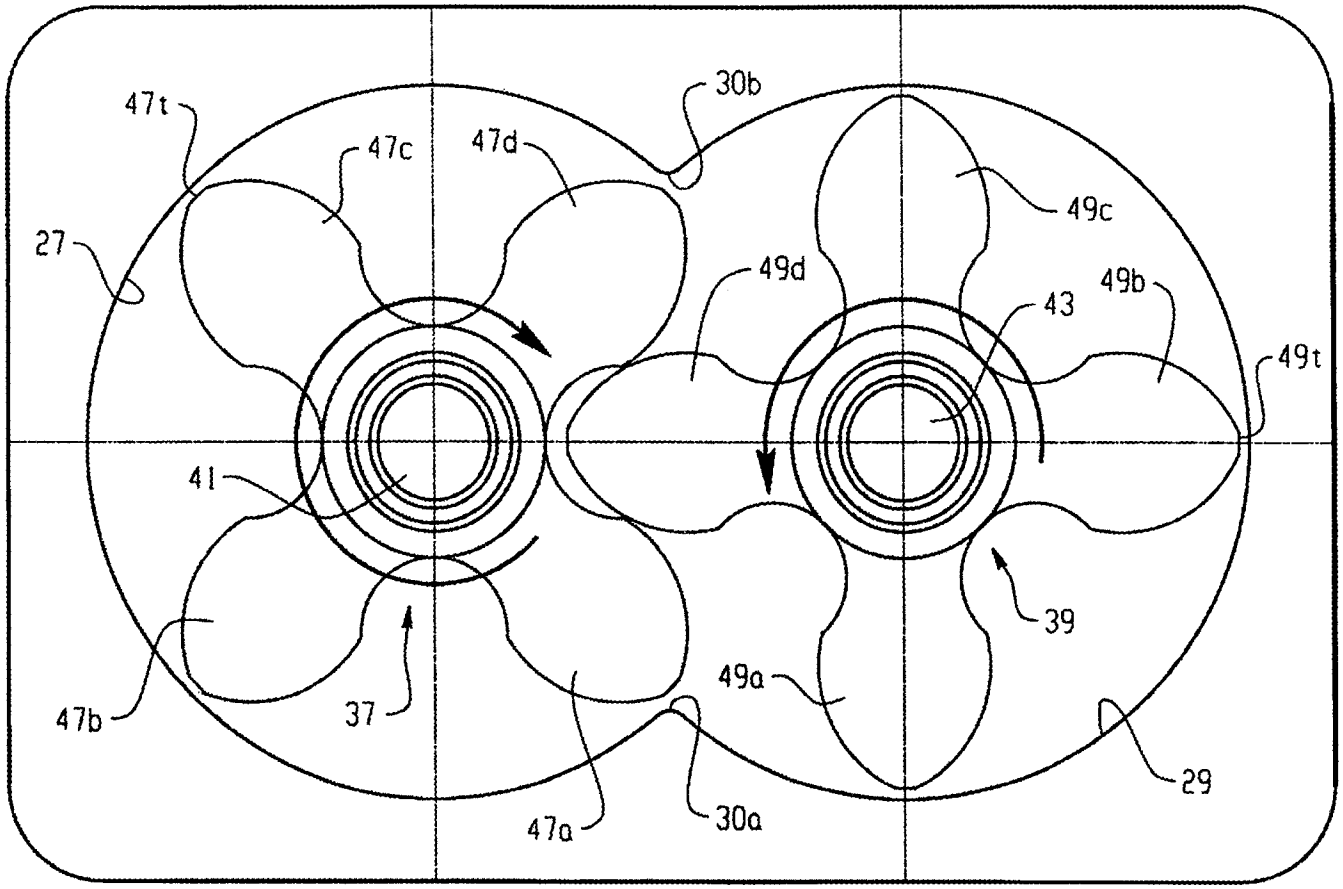
FIG. 5 is a diagrammatic view corresponding to a transverse cross-section through a blower in accordance with examples of the present disclosure, illustrating overlapping rotor chambers and rotor lobes.

Referring now to FIGS. 4 and 5, the blower housing 13 may define a pair of transversely overlapping cylindrical chambers 27 and 29, such that in FIG. 4, the view is from the chamber 27 into the chamber 29. In FIG. 5, the chamber 29 is generally designated as the right hand chamber, and FIG. 5 is a view taken from a rearward end (e.g., right end in FIG. 4) of the rotor chambers 27, 29 (e.g., looking forwardly in the engine compartment). The blower chambers 27 and 29 may overlap at an inlet cusp 30*a* (which may be in-line with the inlet port 17), and may overlap at an outlet cusp 30*b* (which may be in-line with, and actually may be interrupted by the outlet port 19).

Referring now primarily to FIG. 4, the blower housing 13 may define a first end wall 31 through which inlet port 17 may passes, and the first end wall 31 may be referenced herein as "defining" the inlet port 17. At the forward end of the chambers 27 and 29, the blower housing 13 may define a second end wall 33 that may separate the cylindrical rotor chambers 27 and 29 from a gear chamber 35. In various examples of the present teachings, gear chamber 35 may contain timing gears, one of which is shown partially broken away and designated TG.

Figure 6:
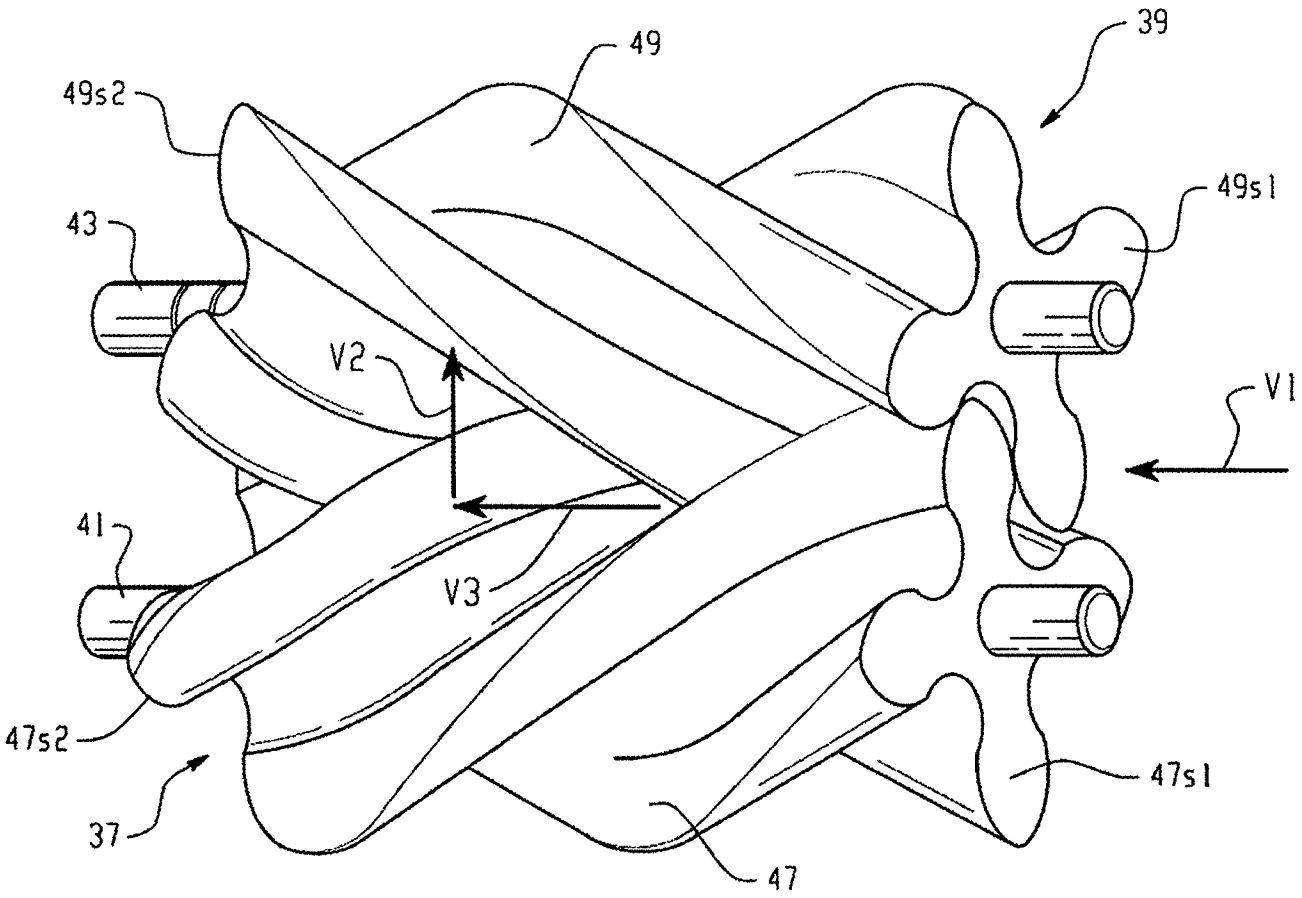
FIG. 6 is a top plan view of the rotor set shown diagrammatically in FIG. 5, and illustrating the helix angle of the lobes.

Referring now primarily to FIG. 5, but also to FIG. 6, a first rotor 37 may be disposed within the rotor chamber 27, and a second rotor 39 may be disposed within the rotor chamber 29. The rotor 37 may be fixed relative to a rotor shaft 41 and the rotor 39 may be fixed relative to a rotor shaft 43. There may be a number of different methods known and available for forming blower rotors, and for thereafter fixedly mounting such rotors on their rotor shafts. For example, solid rotors may be used that may have lobes hobbed by a hobbing cutter and/or hollow rotors may be extruded, and the ends thereof may be enclosed or sealed. The present disclosure may be utilized in connection with lobes of any type, no matter how formed, and in connection with any manner of mounting the rotors to the rotor shafts.

In various examples of the present teachings, each of the rotors 37 and 39 may have a plurality N of lobes. The rotor 37 may have lobes generally designated 47 and the rotor 39 may have lobes generally designated 49. In examples of the present teachings, the plurality N may be illustrated to be equal to four, such that the rotor 37 may include lobes 47*a*, 47*b*, 47*c*, and 47*d*. In the same manner, the rotor 39 may include lobes 49*a*, 49*b*, 49*c*, and 49*d*. The lobes 47 have axially facing end surfaces 47*s*1 and 47*s*2, while the lobes 49 have axially facing end surfaces 49*s*1 and 49*s*2. It should be noted that in FIG. 6, the end surfaces 47*s*1 and 49*s*1 are actually visible, whereas for the end surfaces 47*s*2 and 49*s*2, the lead lines merely "lead to" the ends of the lobes because the end surfaces are not visible in FIG. 6. The end surfaces 47*s*1 and 49*s*1 sealingly cooperate with the first end wall 31, while the end surfaces 47*s*2 and 49*s*2 sealingly cooperate with the second end wall 33, in a manner well known to those skilled in the art, and which is not directly related to the present teachings. In embodiments, for example only, the lobes may include a cross-sectional shape that may include a relatively thin stem extending radially outward toward a generally triangular formation having a base connected to the stem and curved legs extending from the base to form a top land (e.g., the cross-sectional shape may generally resemble a rounded shovel). With embodiments, the lobes may be separated by generally semi-circular recesses.

When viewing the rotors from the inlet end as in FIG. 5, the left hand rotor 37 may rotate clockwise, while the right hand rotor 39 may rotate counterclockwise. Therefore, air which flows into the rotor chambers 27 and 29 through the inlet port 17 will flow into, for example, a control volume defined between the lobes 47*a* and 47*b*, or between the lobes 49*a* and 49*b*, and the air contained in those control volumes will be carried by their respective lobes, and in their respective directions around the chambers 27 and 29, respectively, until those particular control volumes are in communication with the outlet port 19. Each of the lobes 47 includes a top land 47*t*, and each of the lobes 49 includes a top land 49*t*, the top lands 47*t* and 49*t* sealingly cooperating with the cylindrical chambers 27 and 29, respectively, as is also well known in the art, and will not be described further herein.

In one aspect of the present teachings, a control volume may include the region or volume between two adjacent unmeshed lobes, after the trailing lobe has traversed the inlet cusp, and before the leading lobe has traversed the outlet cusp. However, it will be understood by those skilled in the art that the region between two adjacent lobes (e.g., lobes 47*d* and 47*a*) may also pass through the rotor mesh, such as lobe 49*d*, which is shown generally in mesh between the lobes 47*d* and 47*a* in FIG. 5. Each region, or control volume, may pass through the four phases of operation described above (e.g., the inlet phase; the transfer phase; the backflow phase; and the outlet phase). As generally illustrated in FIG. 5, a control volume between the lobes 47*a* and 47*b* (and between lobes 49*a* and 49*b*) may comprise the inlet phase and/or the control volume between lobes 47*b* and 47*c* may comprise the inlet phase. The control volume between the lobes 47*c* and 47*d* is in the transfer phase, just prior to the backflow phase. If the lobe 47*d* passes the outlet cusp 30*b* in FIG. 5, the control volume between it and the lobe 47*c* may be exposed to the backflow phase. If the lobe 47*d* passes the outlet cusp 30*b*, at the plane of the inlet port (FIG. 5), the control volume may be exposed to the outlet pressure through an internal backflow passage, to be described subsequently. To insure that there is not a leak back to the inlet port 17, the control volume between lobes 47*c* and 47*d* may be completely out of communication with the inlet port 17, (e.g., out of the inlet phase). With embodiments, if the lobe 47*d* is the leading lobe, and the lobe 47*c* is the trailing lobe of the control volume, it may be desirable for the trailing lobe 47*c* to still be sealed to the chamber 27 at the peak of the inlet cusp 30*a*, when the leading lobe 47*d* is still sealed to the outlet cusp 30*b*, as shown in FIG. 5. The above configuration may correspond to a maximum amount of seal time for the inlet seal time and the transfer seal time, together, which may be significant in determining the maximum, ideal twist angle subsequently.

The performance of a Roots-type blower may be improved by increasing the twist angle of the rotor lobes. Increasing the twist angle of rotor lobes may not, in and of itself, directly improve the performance of the blower. However, increasing the twist angle of the rotor lobes may permit an increase in the helix angle of each lobe. For each blower configuration, it is possible to determine a maximum ideal twist angle which may then be utilized to determine an optimum helix angle. A maximum ideal twist angle may include the largest possible twist angle for each rotor lobe without opening a leak path from the outlet port 19 back to the inlet port 17 through the lobe mesh.

Figure 7:
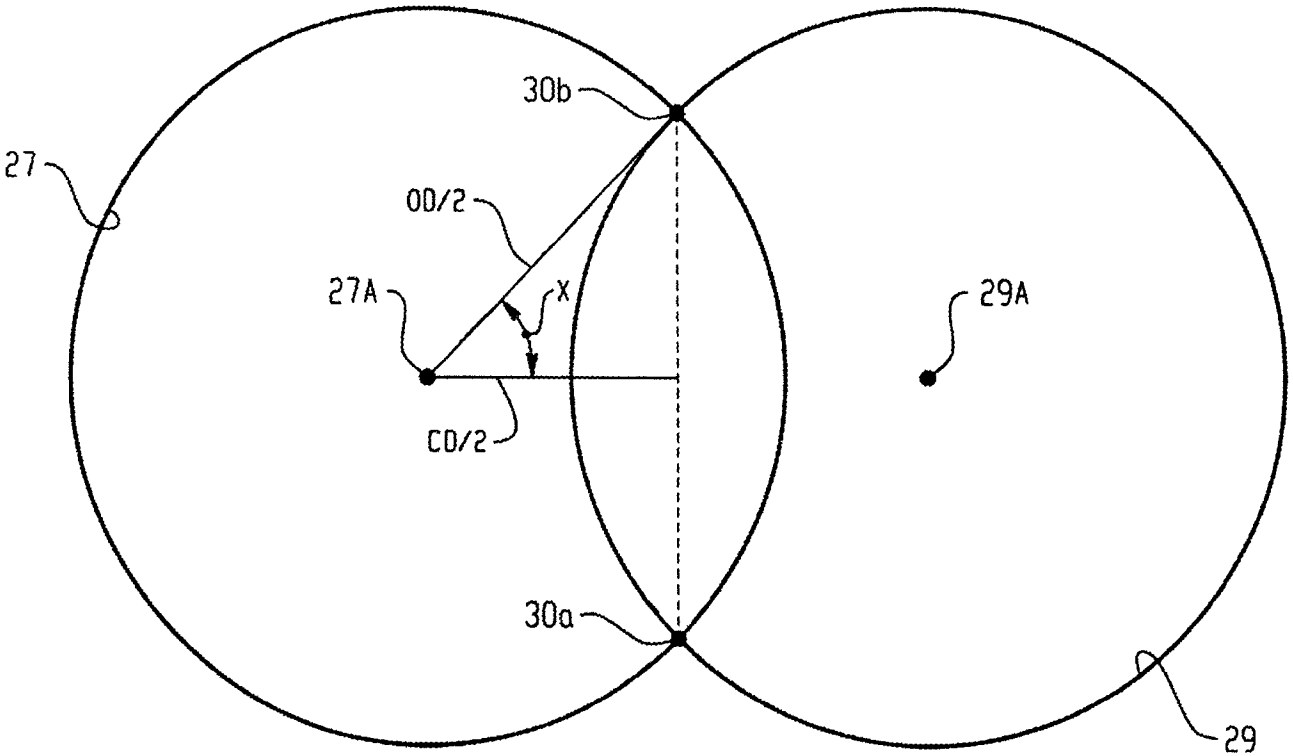
FIG. 7 is a geometric view representing rotor chambers in accordance with aspects of the present teachings, which may be used in determining the maximum ideal twist angle.

Referring now primarily to FIG. 7, there may be an "ideal" maximum twist angle, and that once the ideal maximum twist angle is determined, it can be used to determine a maximum (optimum) helix angle for the lobes 47 and 49. FIG. 7 illustrates a geometric view of the rotor chambers (overlapping cylindrical chambers) 27 and 29 which define chamber axes 27*a* and 29*a*, respectively. As may best be seen by comparing FIG. 7 to FIG. 5, the chamber axis 27*a* may be the axis of rotation of the rotor shaft 41, while the chamber axis 29*a* may be the axis of rotation of the rotor shaft 43. In various examples of the present teachings, such as generally illustrated in FIG. 7, a line CD/2 may represent one-half of the center-to-center distance between the chamber axes 27*a* and 29*a*.

The cylindrical chambers 27 and 29 may overlap along lines, such as at the inlet cusp 30*a* and the outlet cusp 30*b*. In various examples of the present teachings, such as generally illustrated in FIG. 7, dimension OD/2 may substantially equal one-half of the outside diameter defined by the rotor lobes 47 or 49. Determining the ideal maximum twist angle may include determining the rotational angle between the inlet cusp 30*a* and the outlet cusp 30*b*. As generally illustrated in FIG. 7, angle X may represent one-half of the angle between the inlet cusp 30*a* and the outlet cusp 30*b*. The angle X may be determined by the equation:

Cosine $X=CD/OD$; or stated another way, $X=\text{Arc cos } CD/OD.$

From the above, it has been determined that the maximum ideal twist angle ($TA_M$) may be determined as follows:

$TA_M=360-(2 \text{ times } X)-(360/N)$; wherein 2 times X=cusp-to-cusp separation N=the number of lobes per rotor 360/N=lobe-to-lobe separation.

In various examples of the present teachings, the maximum ideal twist angle ($TA_M$) may be determined to be about 170 degrees. It should be understood that, utilizing the above relationship, a twist angle for the lobes 47 and 49 may be calculated that may result in a total maximum seal time for the inlet seal time and the transfer seal time, together, which may include the transfer seal time being equal to zero. Such an allocation of seal times between the inlet and transfer (e.g., transfer seal time=0) may lead to the ideal maximum twist angle, which may be desirable for relatively high speed performance of blower 11. It may be desirable for optimum performance to be at a relatively lower speed of blower 11, the inlet seal time may be reduced, and the transfer seal time may be increased, correspondingly, but the total of inlet and transfer time may remain constant. In other words, the portion/shapes of the rotors 37, 39 of blower 11 may be "tuned" for a particular application (e.g., a particular vehicle and/or engine). A method of designing a rotor for a Roots-type blower may include determining an "optimum" helix angle, at which the "transfer" seal time is zero. Then if improved low-speed efficiency is desired for a particular application, the transfer seal time may be increased, as described above, with the inlet seal time decreasing accordingly, and the maximum ideal twist angle ($TA_M$) also decreasing accordingly.

In accordance with the present teachings, a next step in the design method may include utilizing the maximum ideal twist angle $TA_M$ and the lobe length to calculate the helix angle (HA) for each of the lobes 47 or 49. By adjusting the lobe length, the optimal helix angle may be achieved. As was mentioned previously, the helix angle HA may be calculated at the pitch circle (or pitch diameter) of the rotors 37 and 39, as those terms are well understood to those skilled in the gear and rotor art. In various aspects of the present teachings, the maximum ideal twist angle $TA_M$ may be calculated to be approximately 170 degrees, the helix angle HA may be calculated as follows:

Helix Angle (HA)=(180/π*arctan(PD/Lead))

wherein:

PD=pitch diameter of the rotor lobes; and

Lead=the lobe length required for the lobe to complete 360 degrees of twist, the Lead being a function of the twist angle ($TA_M$) and the length of the lobe.

In other examples of the present teachings, the helix angle HA may be calculated to be at least 24 degrees, and/or in a range of about 24 to 32 degrees, such as, about 25 degrees and/or about 29 degrees. In further examples, the helix angle HA may be calculated to be less than 24 degrees and/or greater than 32 degrees. In embodiments, the maximum ideal twist angle may be determined to be in a range of about 140 to about 180 degrees, such as between about 150 and about 160 degrees.

In various examples of the present teachings, it may be possible to increase the size and flow area of the inlet port 17. As may be appreciated by viewing FIG. 1, in conjunction with FIG. 5, the inlet port 17 may include a greater arcuate or rotational extent (e.g., greater than conventional), on each side of the inlet cusp 30*a*, which may increase the period of time during which incoming air is flowing through the inlet port 17 into the control volumes between adjacent lobes. Conventional inlet ports, such as conventional inlet port 17', may only be in fluid communication with two control volumes at any one time. For example, conventional inlet port 17', such as generally illustrated in FIG. 3, may permit air to flow into control volume 50*a'* to the left of the lobe 45*a* (e.g., between lobe 45*a* and lobe 45*b*, which is hidden in FIG. 3), and may provide at least partial filling of a control volume 50*b'* to the right of lobe 46*a* (e.g., between lobe 46*a* and lobe 46*b*, which is hidden in FIG. 3). In contrast, as may be seen by comparing FIGS. 1, 2, and 5, the inlet port 17 of the present teachings may be in fluid communication with more than two control volumes in at least one rotational position of rotors 37, 39. For example, and without limitation, inlet port 17 may be in fluid communication with four control volumes, which may include a control volume 50*a* that may be between lobe 47*b* and 47*c*, a control volume 50*b* that may be between 49*a* and 49*b*, a control volume 50*c* that may be between lobes 49*b* and 49*c*, and/or a control volume 50*d* that may be between lobes 47*c* and 47*d* (lobe 47*d* is hidden in FIG. 2).

In examples of the present teachings of blower 11, rotors 37, 39 may include greatly increased helix angles (HA) of their respective lobes 47 and 49. In further aspects of the present teachings, it may be desirable to avoid and/or minimize a "mismatch" between the linear velocities of air entering the rotor chambers through the inlet port 17 and the linear velocity of the lobe mesh. In FIG. 6, there are arrows labeled to identify various quantities:

V1=linear velocity of inlet air flowing through the inlet port 17;

V2=linear velocity of the rotor lobe in the radial direction; and

V3=linear velocity of the lobe mesh.

In various examples of the present teachings, V1 may be equal to the rotational speed of blower (RPM) multiplied by the displacement of blower 11, all divided by the area of inlet 17. Moreover, V2 may be equal to the rotational speed of blower (RPM) multiplied by the radius of rotor 37 and/or rotor 39. V3 may equal V2 divided by the tangent of the helix angle of rotor 37 and/or rotor 39.

Figure 8:
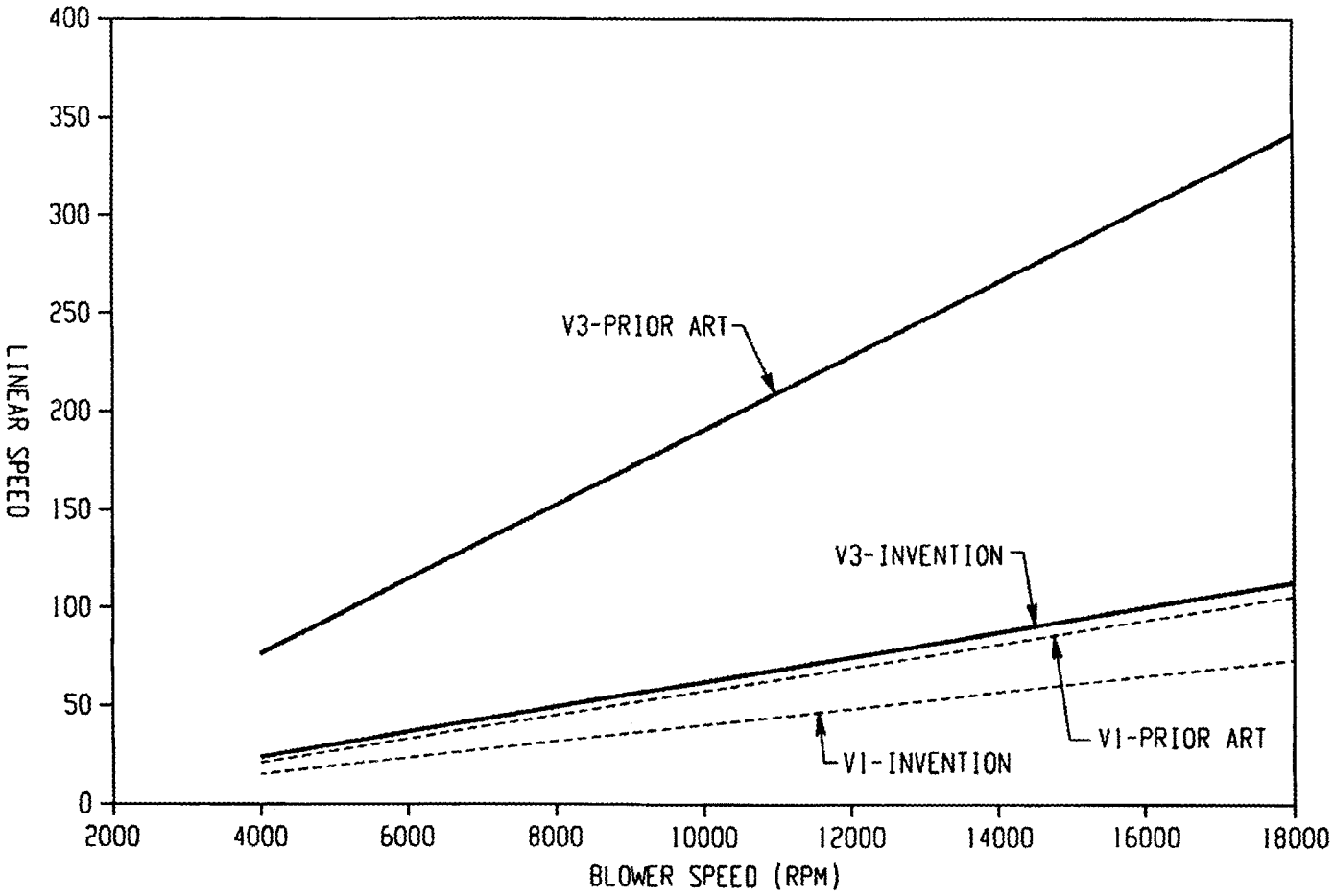
FIG. 8 is a graph of linear speed, in meters/second, showing both lobe mesh and inlet air speed, as a function of blower rotor speed of rotation (in RPM), comparing examples of the present disclosure to conventional configurations.

Referring still to FIG. 6, but now in conjunction with the graph of FIG. 8, it may be seen that with conventional Roots-type blowers (the data generally identified as "Prior Art" in the Figure), which have the comparatively much smaller helix angles, there can be a substantial mismatch between V1 and V3. The mismatch can be sufficiently large such that, in "Prior Art" devices, the linear speed V3 of the lobe mesh travels several times faster than the flow of inlet air V1, which may create a substantial amount of undesirable turbulence and/or a vacuum. Previously, it has been observed that, at approximately 8,500 rpm, the "generated noise" would exceed 100 db.

In various examples of the present teachings, it may be seen in FIG. 8 that the gap between V1 and V3 may be much smaller, which may allow for much less turbulence and much less likelihood of drawing a vacuum. Examples of the present disclosure have been tested and generated noise does not exceed 100 db, even as the blower speed has increased to greater than 16,000 rpm. In further examples of the present teachings, such as generally illustrated via FIG. 8, for certain rotor lobe configurations (e.g., helix angles), V1 may "lag" V3, but as the helix angle HA increases, the linear velocity V3 of the lobe mesh decreases, which may decrease the gap between V3 and V1. A decreased gap between V3 and V1 may permit less air turbulence (pulsation), less vacuum being drawn, and/or less noise being generated.

Figure 9:
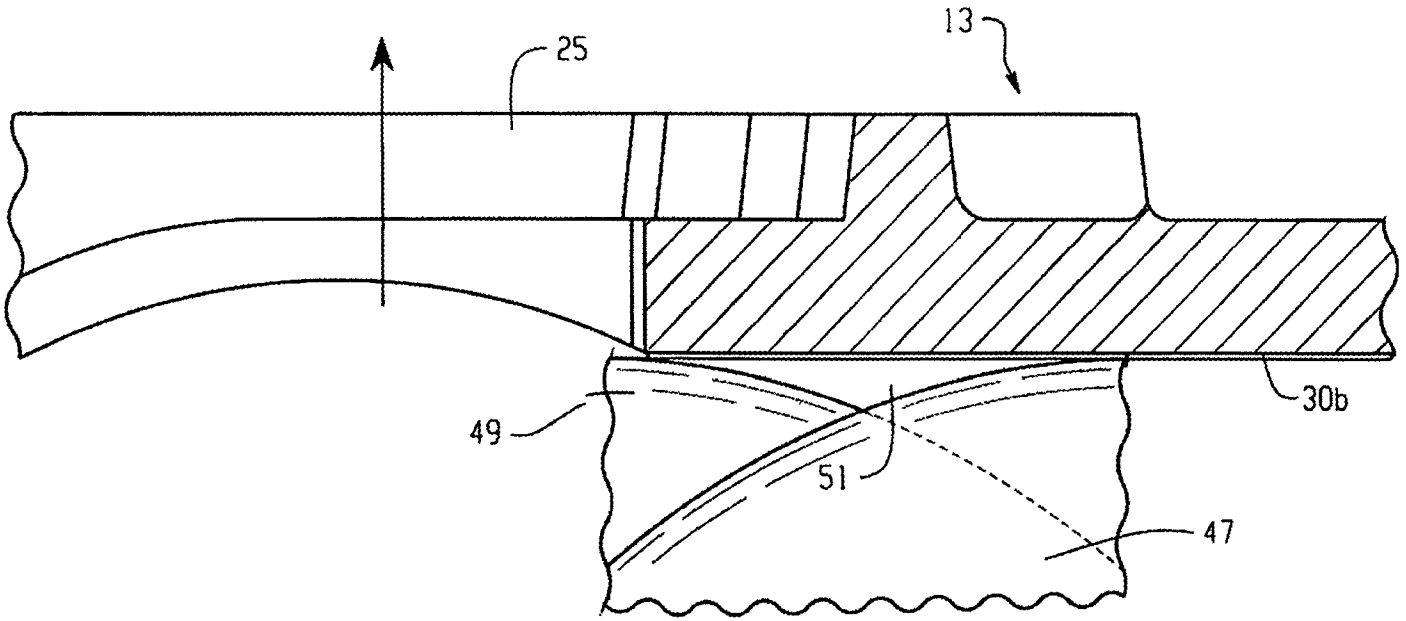
FIG. 9 is an enlarged, fragmentary, axial cross-section view showing a portion of the lobe mesh according to examples of the present disclosure.
Figure 10:
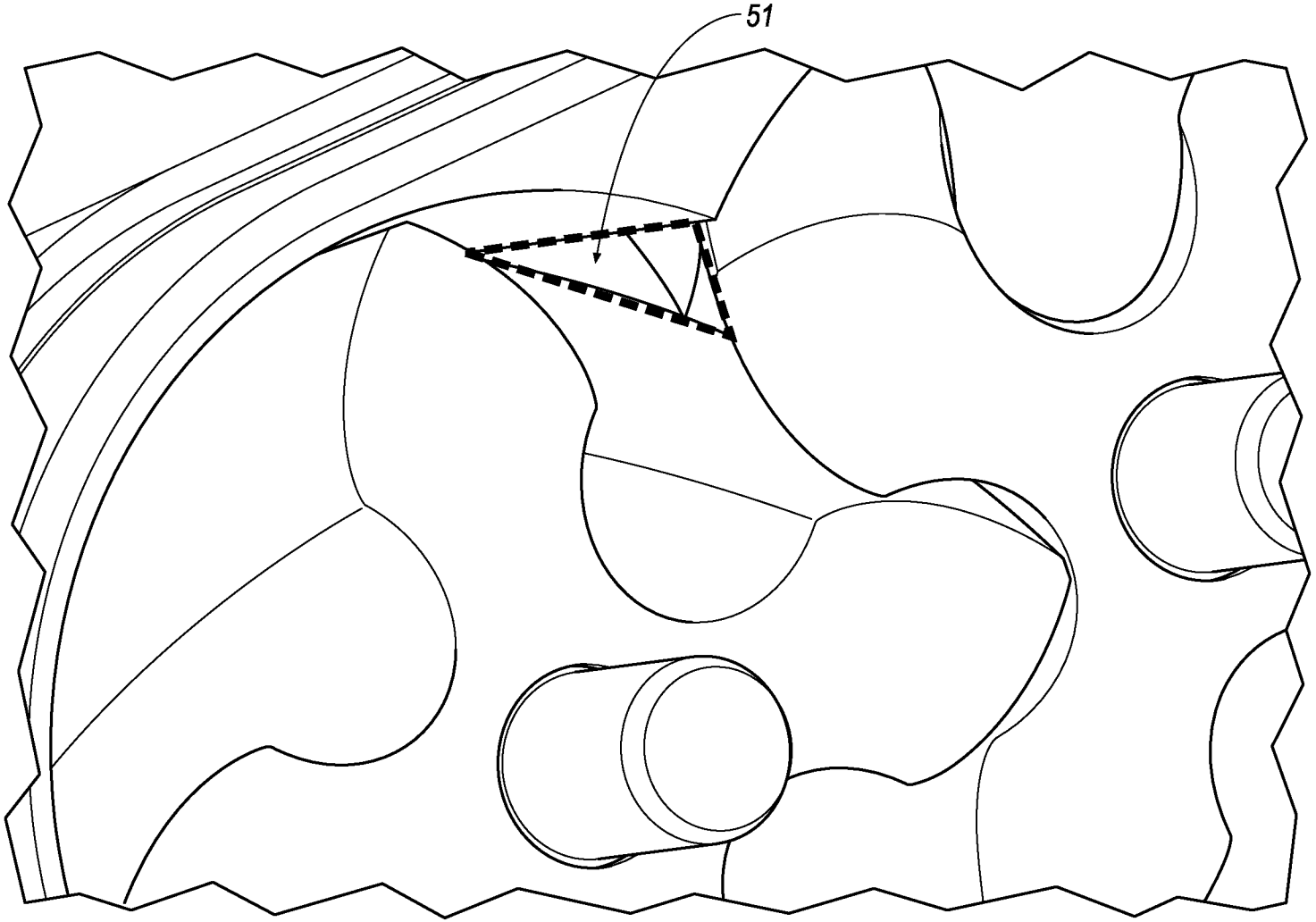
FIG. 10 is an enlarged, partial cross-sectional view showing portions of examples of a Roots-type blower in accordance with teachings of the present disclosure.

Referring now primarily to FIGS. 9 and 10, a potential advantage of a substantially increased helix angle HA will be described. As the rotors 37 and 39 rotate, the lobes of rotors 37 and 39 (e.g., 47*a*, 49*a*, etc.) may move into and out of mesh and, instantaneously, may cooperate with the adjacent surface of the rotor chambers 27 and 29, along the outlet cusp 30*b*, to define a blowhole, generally designated 51. A blowhole 51 may also be referred to as a backflow port 51 or as an internal backflow passage 51. As each internal backflow passage 51 is generated by the meshing of the lobes, an internal backflow passage 51 may internally (e.g., within housing 13) provide fluid communication between a first control volume and its preceding control volume. This has been referenced previously as the backflow phase or "event" and this backflow event may allow the first control volume to equalize in pressure prior to opening to the outlet port 19.

In examples of the present teachings, formation of a blow hole/internal backflow passage 51 may occur in a cyclic manner, which may include one internal backflow passage 51 being formed by two adjacent, meshing lobes 47 and 49, and the internal backflow passage may move linearly as the lobe mesh moves linearly, in a direction toward the outlet port 19. The internal backflow passage 51 may be present until it linearly reaches the outlet port 19. There can be several internal backflow passages 51 generated and present at any one time, depending on the extent of the backflow seal time. A backflow event involving a plurality of internal backflow passages 51 may be desirable as it may create a continuous backflow event that is distributed over several control volumes, which has the potential to even out the transition to the outlet event or phase over a longer time period, which may improve the efficiency of the backflow event.

It will be appreciated in light of the present disclosure that an advantage of the formation of the internal backflow passage 51, which may result from the greater helix angle HA, is that backflow slots on either side of the outlet port 19 (e.g., typically, one parallel to each side surface 23 or 25) may not be included. In some examples of the present teachings, as may best be seen in FIG. 1, there may be no provision in the blower housing 13, adjacent the outlet port 19 for such backflow slots.

It will be appreciated in light of the present disclosure that another advantage of the greater helix angle may include that the blower 11 may be able to operate at a higher pressure ratio, which may include a ratio of the outlet pressure (in psia) to inlet pressure (also in psia). By way of contrast, previous Roots blower superchargers would reach an operating temperature of 150 degrees Celsius (outlet port 19 air temperature) at a pressure ratio of about 2.0. The blower 11 has been found to be capable of operating at a pressure ratio of about 2.4 before reaching the determined "limit" of 150° Celsius outlet air temperature. This greater pressure ratio represents a much greater potential capability to increase the power output of the engine.

In general, a performance difference between screw compressor type superchargers and conventional Roots blower superchargers may include that conventional Roots-type blowers (e.g., with smaller helix angles) do not generate any internal compression (e.g., does not actually compress the air within the blower, but merely transfers the air). In contrast, the typical screw compressor supercharger does internally compress the air. However, examples of the present teachings of Roots-type blower 11 may generate a certain amount of internal compression. At relatively low speeds, when typically less boost is required, the internal backflow passage 51 (or more accurately, the series of internal backflow passages 51) serves as a "leak path" such that there is no internal compression. If the blower speed increases (for example, as the blower rotors are rotating at 10,000 rpm and then 12,000 rpm etc.) and a correspondingly greater amount of air is being moved, the internal backflow passages 51 may still relieve some of the built-up air pressure, but as the speed increases, the internal backflow passages 51 may not be able to relieve enough of the air pressure to prevent the occurrence of internal compression, such that above some particular input speed (blower speed), just as there is a need for more boost to the engine, the internal compression gradually increases. In various examples of the present teachings, certain parameters of blower 11 can be configured to tailor the relationship of internal compression versus blower speed, for example, to suit a particular vehicle engine application. In embodiments, such internal compression behavior may be a result, at least in part, of an increased/optimized helix angle of the rotors.

Figure 11:
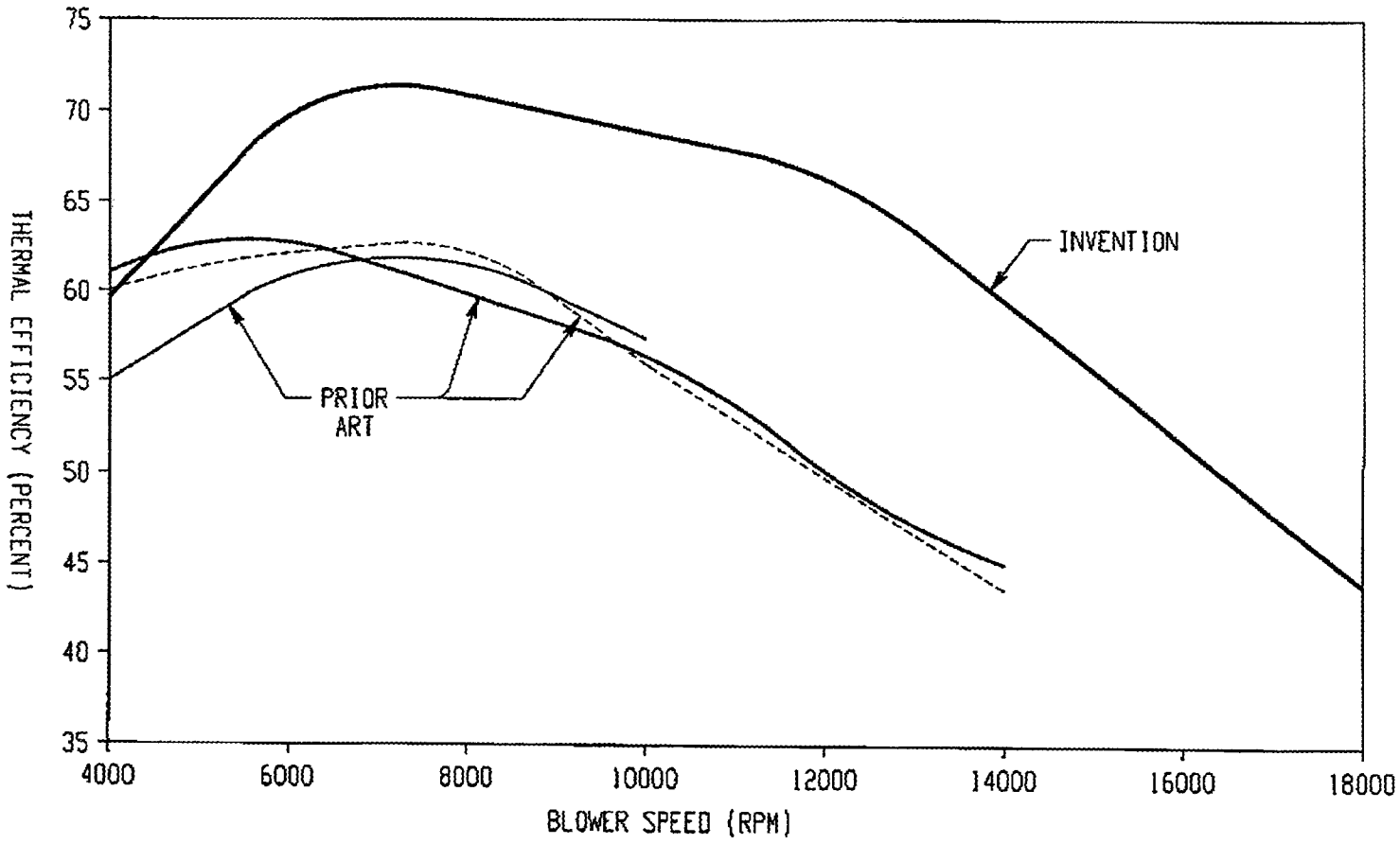
FIG. 11 is a graph of thermal efficiency, as a percent, versus blower rotor speed of rotation (in RPM), comparing examples of the present disclosure to conventional configurations.

Referring now primarily to FIG. 11, there is provided a graph of thermal efficiency as a function of blower speed in RPM. It may be seen in FIG. 11 that there are three graphs representative of Prior Art devices, with two prior art Roots-type blowers being represented by the graphs which terminate at 14,000 rpm. The third Prior Art device may correspond to a screw compressor, for which the graph in FIG. 8 representing that device terminates at 10,000 RPM, it being understood in light of the present disclosure that the screw compressor could have been driven at a higher speed, but that the test was stopped. As used herein, terminate may refer to (e.g., in reference to the Prior Art graphs in FIG. 11) the unit reaching the determined limit of 150 degrees Celsius outlet air temperature, discussed previously. If that air temperature is reached, the blower speed may not be increased any further and the test may be stopped.

In contrast, it may be seen in FIG. 11 that a Roots-type blower made in accordance with examples of the present teachings (such as the example labeled "INVENTION") may achieve a higher thermal efficiency than any of the Prior Art devices, for example at about 4,500 rpm blower speed. In examples of the present teachings, the thermal efficiency of blower 11 may remain substantially above that of the Prior Art devices for all subsequent blower speeds. Moreover, the limit of 150° Celsius outlet air temperature may not occur until the blower 11 reached speeds in excess of 18,000 rpm.

Although the present teachings have been illustrated and described in connection with a Roots-type blower in which each of the rotors 37 and 39 has an involute, four lobe (N=4) design, it should be understood that the present teachings are not so limited. The involute rotor profile has been used in connection with the aspects set forth in this disclosure by way of example, and the benefits of the present teachings are not limited to any particular rotor profile. For example, and without limitation, some examples of the present teachings of Roots-type blower 11 may include 3, 4, or 5 lobes, such as if the blower is to be used as an automotive engine supercharger.

In examples of the present teachings, the number of lobes per rotor (N) may be less than 3 or greater than 5. Moreover, the maximum ideal twist angle ($TA_M$) may change for different numbers (N) of lobes per rotor. In referring back to the equation:

$$TA_M = 360 - (2 \text{ times } X) - (360/N)$$

and assuming that CD and OD remain constant as the number of lobes N is varied, it may be seen in the equation that the first part (360) and the second part (2 times X) may not be affected by the variation in the number of lobes, but instead, only the third part, (360/N) may change.

In examples of the present teachings, as the number of lobes N changes from 3 to 4 to 5, the change in the maximum ideal twist angle $TA_M$ (and assuming the same CD and OD as used previously) may, for example, vary as follows:

$$\text{for } N=3,\ TA_M = 360 - (2 \text{ times } 50) - (360/3) = 140°;$$

$$\text{for } N=4,\ TA_M = 360 - (2 \text{ times } 50) - (360/4) = 170°; \text{ and}$$

$$\text{for } N=5,\ TA_M = 360 - (2 \text{ times } 50) - (360/5) = 188°$$

Moreover, once the maximum ideal twist angle $TA_M$ is determined/calculated, the helix angle HA may be calculated knowing the length, based upon the diameter (PD) at the pitch circle, and the Lead.

Various embodiments are described herein to various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "embodiments," "one embodiment," or "an embodiment," or the like, means that a particular feature, structure, or characteristic described in connection with the embodiment is included in at least one embodiment. Thus, appearances of the phrases "in various embodiments," "in embodiments," "in one embodiment," "with embodiments" or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It should be understood that references to a single element are not so limited and may include one or more of such element. All directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." throughout the specification is to be construed broadly and is used to provide non-limiting examples of embodiments of the disclosure, and the disclosure is not limited to such examples. It is intended that all matter contained in the above description or shown in the accompanying drawings shall be interpreted as illustrative only and not limiting. Changes in detail or structure may be made without departing from the present disclosure.

What is claimed is:

1. A blower comprising:

a plurality of substantially identical rotors, each rotor having a plurality of lobes; and a blower housing;

wherein the plurality of lobes of the plurality of rotors include a twist angle and a helix angle that is a function of the twist angle and a pitch diameter of the plurality of rotors; and the helix angle is at least 24 degrees.

2. The blower of claim 1, wherein the blower housing includes a plurality of control volumes; and each of the plurality of control volumes is disposed between two adjacent unmeshed lobes of the plurality of lobes.

3. The blower of claim 2, wherein each of the plurality of control volumes corresponds to a trailing lobe and a leading lobe of the plurality of lobes.

4. The blower of claim 3, wherein the leading and trailing lobes corresponding to each of the plurality of control volumes are disposed between inlet and outlet cusps of the blower housing.

5. The blower of claim 1, wherein the helix angle is at least 29 degrees.

6. The blower of claim 1, wherein the helix angle is at least 25 degrees.

7. The blower of claim 1, wherein the helix angle is less than 32 degrees.

8. The blower of claim 1, wherein the twist angle is in a range of 140 degrees to 180 degrees.

9. The blower of claim 1, wherein the twist angle is in a range of 150 degrees to 160 degrees.

10. The blower of claim 1, wherein the blower housing and the plurality of rotors are configured, independently from any backflow slots, to generate a plurality of cyclically occurring internal backflow passages configured to move linearly in a direction toward an axial inlet port of the blower housing.

11. The blower of claim 1, wherein the twist angle is a maximum ideal twist angle that does not open a leak path between inlet and outlet ports of the blower housing; and the maximum ideal twist angle is at least 150 degrees.

12. The blower of claim 1, wherein the blower is configured to generate internal compression when the plurality of rotors are rotating at a first speed and not to generate internal compression when the plurality of rotors are rotating at a second speed.

13. A blower comprising:

a plurality of substantially identical rotors, each rotor having at least three lobes; and a blower housing;

wherein the at least three lobes of the substantially identical rotors include a twist angle, and the twist angle is a maximum twist angle that does not open a leak path from an outlet port of the blower housing back to an inlet port of the blower housing; the at least three lobes includes a helix angle in a range of 24 degrees to 32 degrees; and the helix angle is a function of the twist angle and pitch diameters of the plurality of rotors.

14. The blower of claim 13, wherein the twist angle is 150 degrees to 160 degrees.

15. The blower of claim 13, wherein the blower housing and the plurality of rotors are configured, independently from any backflow slots, to generate a plurality of cyclically occurring internal backflow passages configured to move linearly in a direction toward an axial inlet port of the blower housing.

16. The blower of claim 15, wherein the blower is configured such that (i) at first rotor speeds the cyclically occurring internal backflow passages relieve some internal pressure and (ii) at second rotor speeds the cyclically occurring internal backflow passages do not relieve enough internal pressure to prevent the occurrence of internal compression.

17. A blower comprising:

a plurality of substantially identical rotors, each rotor having at least three lobes; and a blower housing;

wherein the at least three lobes of the substantially identical rotors include a twist angle, and the twist angle is a maximum twist angle that does not open a leak path from an outlet port of the blower housing back to an inlet port of the blower housing; and the twist angle is at least 140 degrees.

18. The blower of claim 17, wherein the at least three lobes of the plurality of rotors includes a helix angle of at least 24 degrees; and helix that is a function of the twist angle and a pitch diameter of the plurality of rotors.

19. The blower of claim 17, wherein the at least three lobes of the plurality of rotors includes a helix angle of at least 29 degrees; and the helix angle is a function of the twist angle and a pitch diameter of the plurality of rotors.

20. The blower of claim 17, wherein the at least three plurality of lobes includes a helix angle in a range of 24 degrees to 32 degrees; and the helix angle is a function of the twist angle and pitch diameters of the plurality of rotors.

21. The blower of claim 17, wherein the twist angle is less than 180 degrees.

* * * * *